United States Patent [19]

Speil

[11] Patent Number: 4,570,582

[45] Date of Patent: Feb. 18, 1986

[54] INNER ELEMENT FOR A HYDRAULIC VALVE PLAY COMPENSATING ELEMENT

[75] Inventor: Walter Speil, Ingolstadt, Fed. Rep. of Germany

[73] Assignee: Motomak Motorenbau, Machinen-und Werkzeugfabrik Konstruktionen GmbH, Ingolstadt, Fed. Rep. of Germany

[21] Appl. No.: 575,916

[22] Filed: Feb. 1, 1984

[30] Foreign Application Priority Data

Feb. 9, 1983 [DE] Fed. Rep. of Germany ..... 3304398

[51] Int. Cl.[4] ..... F01L 1/24

[52] U.S. Cl. ..... 123/90.46; 123/90.55

[58] Field of Search ..... 123/90.46, 90.55, 90.57, 123/90.58, 90.43, 90.56, 90.59

[56] References Cited

U.S. PATENT DOCUMENTS

| | | | |
|---|---|---|---|
| 2,036,936 | 4/1936 | Halford | 123/90.46 |
| 2,941,523 | 6/1960 | Bergman | 123/90.55 |
| 3,516,393 | 6/1970 | Dadel | 123/90.55 X |
| 3,799,129 | 3/1974 | Cornell | 123/90.46 X |
| 4,004,558 | 1/1977 | Scheibe | 123/90.43 X |
| 4,402,285 | 9/1983 | Arai et al. | 123/90.58 |

FOREIGN PATENT DOCUMENTS

| | | | |
|---|---|---|---|
| 2652154 | 5/1978 | Fed. Rep. of Germany | 123/90.46 |
| 32019 | 4/1981 | Japan | 123/90.46 |
| 1400254 | 6/1965 | United Kingdom | 123/90.46 |

*Primary Examiner*—William R. Cline
*Assistant Examiner*—Peggy A. Neils
*Attorney, Agent, or Firm*—Bierman, Peroff & Muserlian

[57] ABSTRACT

A novel inner element for a hydraulic valve play compensation element for internal combustion engines is comprised of a cylindrical element (3) closed at one end and having a reduced outer diameter (7) and a peripheral groove (8) therein at the other open end and a piston element (5) guided therein for longitudinal displacement and projecting from the open end of cylindrical element (3) beyond the latter with a reduced outer diameter (6) in this region, a sheet metal cap (9) with a radial flange (10) engaging the reduced diameter (6) region of piston element (5) and with a cylindrical collar (13) on the open end of cylindrical element (3) engaging on at least some points of its circumference with groove (8), characterized in that sheet metal cap (9) has at least one projection (11,14,15) radially projecting at at least one point about its circumference beyond the outer diameter of cylindrical element (3).

4 Claims, 2 Drawing Figures

INNER ELEMENT FOR A HYDRAULIC VALVE PLAY COMPENSATING ELEMENT

STATE OF THE ART

Hydraulic valve play equalization elements with inner elements are known and used in bores of rocker arms or cap plungers with which they cooperate. However, there is the possibility that these inner elements can slip out of the bores into which they have been inserted before the complete valve play equalization element has been finally installed and therefore, the inner element was prevented from slipping out of the bore by additional contiguous sheet metal elements.

OBJECTS OF THE INVENTION

It is an object of the invention to provide an inner element for a hydraulic valve play compensation element with a safety means for preventing the element from slipping out of its installment bore without an additional element.

These and other advantages and objects of the invention will become obvious from the following detailed description.

THE INVENTION

The novel inner element of the invention for a hydraulic valve play compensation element for internal combustion engines is comprised of a cylindrical element (3) closed at one end and having a reduced outer diameter (7) and a peripheral groove (8) therein at the other open end and a piston element ((5) guided therein for longitudinal displacement and projecting from the open end of cylindrical element (3) beyond the latter with a reduced outer diameter (6) in this region, a sheet metal cap (9) with a radial flange (10) engaging the reduced diameter (6) region of piston element (5) and with a substantially axially extending collar (13) on the open end of cylindrical element (3) engaging on at least some points of its circumference with groove (8), characterized in that sheet metal cap (9) has at least one projection (11,14,15) radially projecting at at least one point about its circumference beyond the outer diameter of cylindrical element (3).

The sheet metal cap has at least one projection about its circumference which radially projects over the outer diameter of the cylindrical element and can engage a diameter enlargement of the bore into which the inner element is inserted. It is not necessary to make the diameter enlargement specially since it is provided anyway for machining reasons at the end of the bore as a means of discharging the machining tool. The projections may be produced in any suitable manner such as chipless formation from the cylindrical collar of the sheet metal cap or cutting a tongue out of the collar of the sheet metal cap with two parallel cuts and bending the tongue obliquely outward.

Referring to the drawings.

Figure 1:
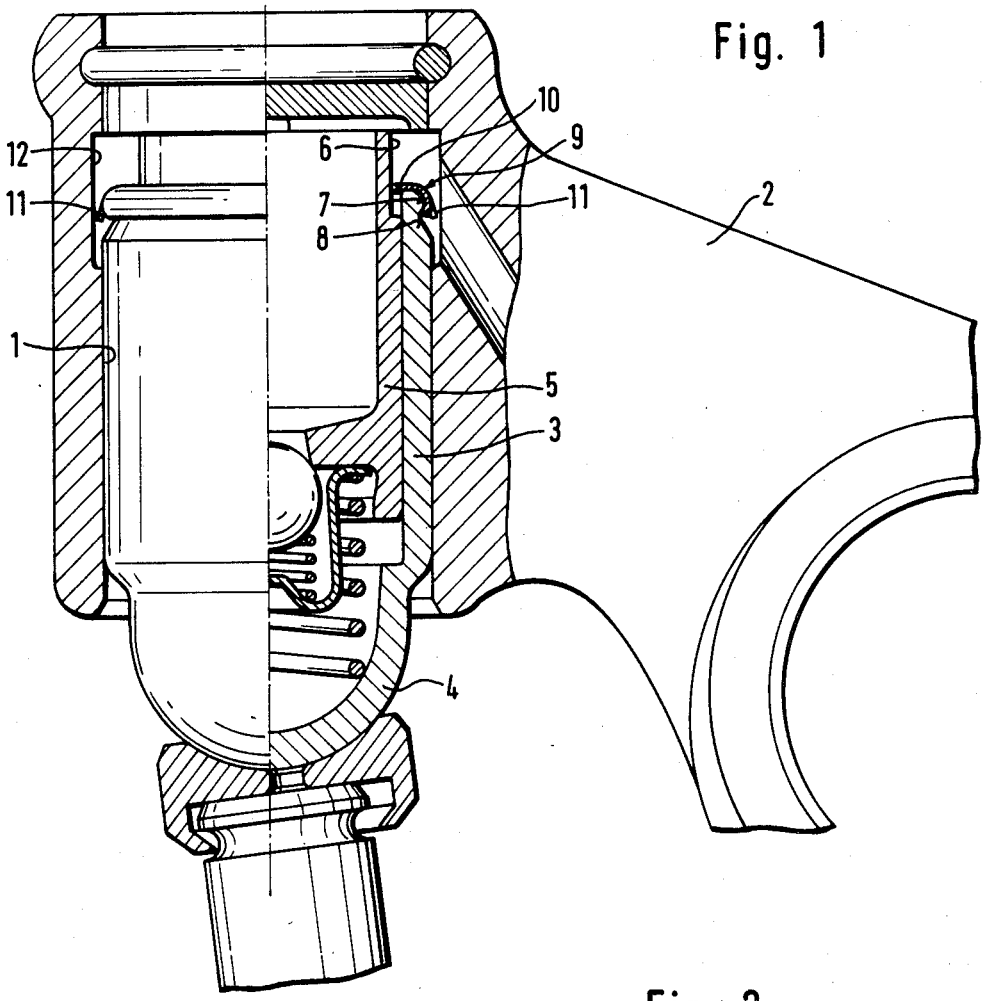
FIG. 1 is a partial cross-sectional view of an inner element of the invention inserted in a rocker arm.

In FIG. 1, an inner element of the invention consisting of cylindrical element 3 with a closed end 4 is inserted in a bore 1 of rocker arm 2 and piston element 5 is guided therein. The known piston element 5 contains a check valve and a known helical spring is arranged between the piston element 5 and the cylindrical element 3 which forces the two elements away from each other.

The piston element 5 projects beyond the open end of cylindrical element 3 and is provided with a reduced outer diameter 6 in this region. The open end of cylindrical element 3 is also provided with a reduced outer diameter 7 in which there is provided a peripheral groove 8. A sheet metal cap 9 is placed onto the reduced end 7 of cylindrical element 3 whereby radial flange 10 engages reduced outer diameter 6 of piston element 5 to prevent the latter from slipping out of cylindrical element 3. Substantially axially extending collar 13 of sheet metal cap 9 engages groove 8 to hold the cap 9 in place and collar 13 is also provided with projections 11 about its circumference which project beyond the reduced outer diameter 7 of cylindrical element 3 and engages enlarged diameter 12 at the end of bore 1 in rocker arm 2 to prevent the entire inner element from slipping out of bore 1.

Figure 2:
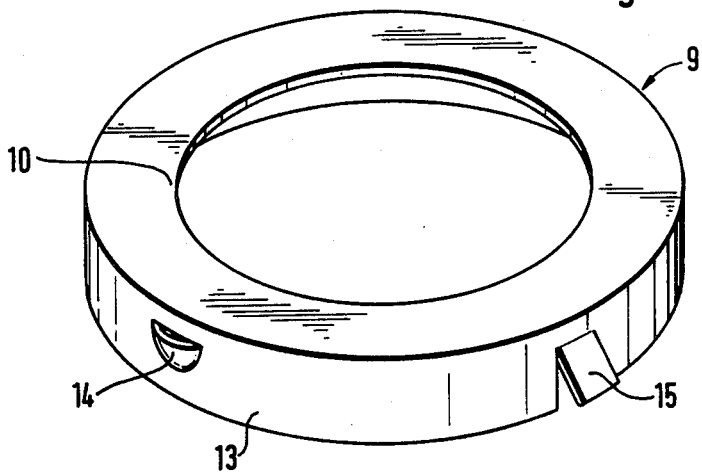
FIG. 2 is a perspective view of another embodiment of the invention of a sheet metal cap showing the projections.

The sheet metal cap 9, shown in perspective in FIG. 2, illustrates that for the formation of a projection from the substantially axially extending collar 13, a triangular elevation 14 may be formed by chipless means. As FIG. 2 further shows, a projection may also be formed by a tongue 15 cut out of substantially axially extending collar 13 with the tongue being bent obliquely outward.

Various modifications of the inner element of the invention may be made without departing from the spirit or scope thereof and it is to be understood that the invention is intended to be limited only as defined in the appended claims.

What I claim is:

1. An internal element for a hydraulic valve play compensating element for internal combustion engines, the internal element comprising a cylinder element closed at one end and being guided for longitudinal displacement in a guide bore of a casing with a closed end, a piston element being guided for longitudinal displacement in the cylinder element and projecting beyond the open end thereof with its one end having a reduced outer diameter and abutting the closed end of the guide bore and a sheet-metal cap having a substantially axially extending collar and a radial flange, the sheet-metal cap by means of its collar being fitted on the open end of the cylinder element having a reduced outer diameter with an additional diameter reduction in the form of a circumferential groove into which the collar engages positively at some circumferential places at least and by means of its flange engaging the one end of the piston element having a reduced outer diameter, the sheet-metal cap also having at at least one place of its circumference a projection radially protruding beyond the outer diameter of the cylinder element and engaging a zone of enlarged diameter of the guide bore located near the closed end thereof.

2. The element of claim 1 wherein the projections (11,14,15) are formed from the substantially axially extending collar (13) of the cap (9).

3. The element of claim 1 wherein the projection (14) is formed by chipless means.

4. The element of claim 1 wherein the projection is a tongue (15) cut out of collar (13) and bent obliquely outward.

* * * * *